US005391106A

United States Patent [19]

Lidert, Jr.

[11] Patent Number: 5,391,106

[45] Date of Patent: Feb. 21, 1995

[54] ANIMATED TOY HAVING A RETRACTABLE APPENDAGE

[76] Inventor: Albert W. Lidert, Jr., 3129 Peachtree Cir., Davie, Fla. 33328

[21] Appl. No.: 201,636

[22] Filed: Feb. 25, 1994

[51] Int. Cl.[6] ..... A63H 3/36; A63H 3/24; A63H 3/12

[52] U.S. Cl. ..... 446/337; 446/304; 446/308; 446/320; 446/321

[58] Field of Search ..... 446/337, 339, 340, 365, 446/368, 369–372, 327, 329, 304, 308, 309, 320, 321, 391, 395, 901; 273/DIG. 30

[56] References Cited

U.S. PATENT DOCUMENTS

| | | | |
|---|---|---|---|
| D. 171,234 | 12/1953 | Sugita | 446/198 X |
| 2,071,225 | 2/1937 | Buttigieg | 446/320 X |
| 4,024,657 | 5/1977 | Dutcher | 446/379 X |
| 4,257,610 | 3/1981 | Ptaszek et al. | 446/339 X |
| 4,555,236 | 11/1985 | Peyton | 446/329 |
| 4,575,350 | 3/1986 | Hippely et al. | 446/368 |
| 4,778,172 | 10/1988 | Bryan | 446/395 X |
| 4,778,433 | 10/1988 | McKay et al. | 446/339 X |
| 4,944,710 | 7/1990 | Sommers | 446/329 |
| 5,080,626 | 1/1992 | Maddi | 446/365 X |
| 5,141,465 | 8/1992 | Stellman | 446/901 X |

FOREIGN PATENT DOCUMENTS

| | | | |
|---|---|---|---|
| 304421 | 3/1955 | Switzerland | 446/198 |

OTHER PUBLICATIONS

"Velcro", *Playthings*, Jul. 1979.

*Primary Examiner*—Max Hindenberg
*Assistant Examiner*—D. Neal Muir
*Attorney, Agent, or Firm*—Malin, Haley, DiMaggio & Crosby

[57] ABSTRACT

An animated toy figure comprising an articulate jaw and a spring actuated tongue member, wherein the articulate jaw defines a mouth movable between an open position for rigidly extending the tongue member away from the mouth and a closed position for storing the tongue member which recoils automatically into the mouth upon actuation, the spring actuated tongue member further including fabric fasteners for attaching small objects to be caught in the tongue member as it recoils into the mouth.

13 Claims, 4 Drawing Sheets

ANIMATED TOY HAVING A RETRACTABLE APPENDAGE

BACKGROUND OF THE INVENTION

1. Field of the Invention

This invention relates generally to animated toys for children, and more particularly, to an animated toy having an extendable and retractable appendage, such as a tongue, that automatically coils and retracts from an extended position when manually actuated.

2. Description of the Background Art

Toys depicting animated characters are well known and designed in a variety of ways for the amusement of children. Oftentimes, these toys incorporate mechanical devices to simulate animals and animal behavior. Generally, the educational purpose of imitating animal behavior in toys is to instill children with imagination, familiarity and comfort in interacting with animals. For instance, one of the most intriguing events that has been documented in nature is a creature, such as a frog, that catches insects with a whip of its tongue.

Various attempts to animate or simulate such activity are known in the background art. For instance, a toy creature having a tongue for capturing prey is disclosed in U.S. Pat. No. 4,778,433, issued to McKay, Oct. 18, 1988. The disclosed toy creature defines a mouth having a hinged upper jaw and a tongue which are simultaneously manipulated by a push-pull member to cause the jaw to move and the tongue to curl. The tongue is formed from a plurality of links pivotally joined together and is connected to the push-pull member which is manually gripped and moved by the user of the toy to extend and retract the tongue. An animated Figure holder, disclosed by Barbato, in U.S. Pat. No. 4,571,198, teaches a holder for animated Figures in the form of a simulated rib cage from a prehistoric beast. A creature with a snap action jaw is illustrated in U.S. Pat. No. 4,561,854, issued to Amici, Dec. 31, 1985, and it comprises a simulated creature having snapping jaws that are pivotally mounted to a body assembly and actuated by a lever arm, a depressible button and a cam portion arrangement. In U.S. Pat. No. 4,469,327, issued Sep. 4, 1984 to Ulrich, an amusement game device includes a dragon like Figure having a body portion, an elongated flexible neck portion, and a head portion with a hook like tongue which picks up rings by moving a plunger assembly for placement into an open cup. Another game is shown in U.S. Pat. No. 4,257,610, issued Mar. 24, 1981 to Ptaszek, and comprises a snapping animal head having a retractable game board in the form of an elongated moving strip that is mechanically self-retracted by a manual winding motor into the Figure of the animal's head. Petrusek, in U.S. Pat. No. 3,738,054, issued Jun. 12, 1973, discloses an animal action toy which comprises an animal having a cord attached to the roof of the animal's mouth at one end and a bug tethered at the other end, whereby, the bug is tossed by hand away from the animal's head and caught with the animal's mouth by compressing the head.

The foregoing inventions disclose a number of animated toys that require complicated linkages and mechanisms to move requisite body parts. However, although various animated toys are disclosed none of them show a toy comprising a creature, such as a frog, dinosaur, or dog having a simulated tongue that is retractable automatically by slight movement, that facilitates the attachment of objects to the tongue and that recoils into a simulated mouth.

SUMMARY OF THE INVENTION

The present invention comprises an animated toy representing a life form, such as a dog, frog, dinosaur, lizard, man, or other creature, such as a plant, having an animated toy body and head wherein the head includes an openable/closeable mouth and jaw and an extendable, retractable tongue member connected in the mouth. The resilient mouth and jaw performs in at least two modes of operation, i.e. manually opened or spring closed. At the same time, the retractable tongue member operates in two corresponding positions which include an extended position (activated manually) and a coiled position. In the first or extended position, the tongue member is rigid, elongated and protrudes from an open jaw which is held open. In the second or coiled position, the simulated mouth becomes closed by a spring after the tongue is actively coiled or rolled up inside a cavity formed by the closed jaw.

The animated toy may be a resilient stuffed animal (or plant) or hard-molded body, depicting any creature or living entity with a universal mouth and jaw that may be moved between the aforementioned closed position and an open position for extending and retracting the tongue attached at one end therein. In the preferred embodiment, the jaw is mechanically configured with a spring hinge such that it can be manipulated to the proper open or closed position with respect to the tongue when extended and retracted. The mouth and jaw preferably comprises an upper jaw member and a lower jaw member forming an articulate jaw hingedly connected at one end, or hingedly connected at each corner of the jaw, in a living hinge arrangement such that the mouth fully opens when the tongue is extended into the first position, and snaps closed forming a cavity when the tongue retracts into the coiled position. The mere impact of the retractable tongue forces the hinged jaws to join or close as it moves from the first position into the second, or coiled, position within the cavity. Alternatively, the underside of the tongue may be attached to the top of the lower jaw member for positive closing of the jaw.

The retractable tongue typically comprises an elongated metal spring actuated band that is either rigidly extended away from the mouth or coiled up within the mouth. The tongue member employs the same spring element used in a toy known under the trademark SLAP WRAPS TM. In the preferred embodiment, the tongue member is fabricated from a long, narrow, thin piece of stainless steel having an arcuate curvature when in the extended position and a flat structure when coiled. The steel has spring actuating characteristics which cause it to recoil from the extended position when the curvature (lateral cross section) is slightly deformed at any tangent to the curvature. Deformation may be effectuated by movement or a downward exerted force on its curved surface. The tongue is manually unwound from its rolled up position inside the jaw cavity to its rigid, elongated and extended position outside the cavity. Potential energy is stored in the member when it is elongated and converted into kinetic energy when the tongue is sufficiently deflected. This deflection releases the kinetic energy and retracts the tongue back into its coiled position within the jaw's cavity. The tongue may be triggered into its second position merely by exerting a downward force on its top surface with a finger or an object.

In the preferred embodiment, the tongue is securely attached inside the throat at one end, and is also attached to the lower jaw member. The tongue is insulated with a fabric pile covering having fabric fasteners disposed on its surface for attaching, catching, and trapping objects, such as toy balls or insects. Typically, fabric fasteners, such as hook and loop, (known under the trademark VELCRO®), may be employed for attaching the foregoing toy objects to the tongue member, wherein the objects may include corresponding fabric fastener attachments. Alternatively, the fabric pile covering may be a furry or fuzzy material having sufficient friction such that an object placed upon the tongue's covering will be frictionally engaged with the tongue as the tongue recoils. Attaching objects to the tongue member allows a child to actually engage the object with the tongue. This makes the tongue member snap back around the object to capture it within the simulated creature's mouth cavity.

To use the present device, the mouth of the simulated creature is opened manually by spreading the jaws apart. In the preferred embodiment, a living hinge arrangement allows the jaw to rest open until forced closed by the triggering of the tongue. To elongate the spring-actuated tongue, the child pulls outward on the tongue member, found coiled in the mouth, until it is fully extended. The tongue remains in a rigid, elongated position, until it retracts slightly as a result of its own natural arcuate construction. Subsequently, the tongue member will recoil automatically when a force is applied on the curvature sufficient to cause a slight deformation. The force may be applied to any portion of the arcuate tongue member. Thus, the child may extend the tongue to its elongated position and perhaps seek other toys to be connected to the tongue until it pushes sufficiently on the spring-actuated band to cause it to recoil. The retraction of the spring actuated band forces the mouth to close automatically, encompassing whatever is attached to the tongue.

It is an object of the present invention to provide an improved action toy for children, involving animated figures and stuffed animals.

It is another object of the present invention to provide a novel action toy for children that includes a manually spring-actuated, automatically-recoilable tongue in an animated creature.

It is a further object of this invention to provide an animated toy having a recoilable, extendable tongue that can capture and retain objects in its simulated mouth.

In accordance with these and other objects which will become apparent hereinafter, the instant invention will now be described with particular reference to the accompanying drawings.

DESCRIPTION OF THE PREFERRED EMBODIMENTS

Figure 1:
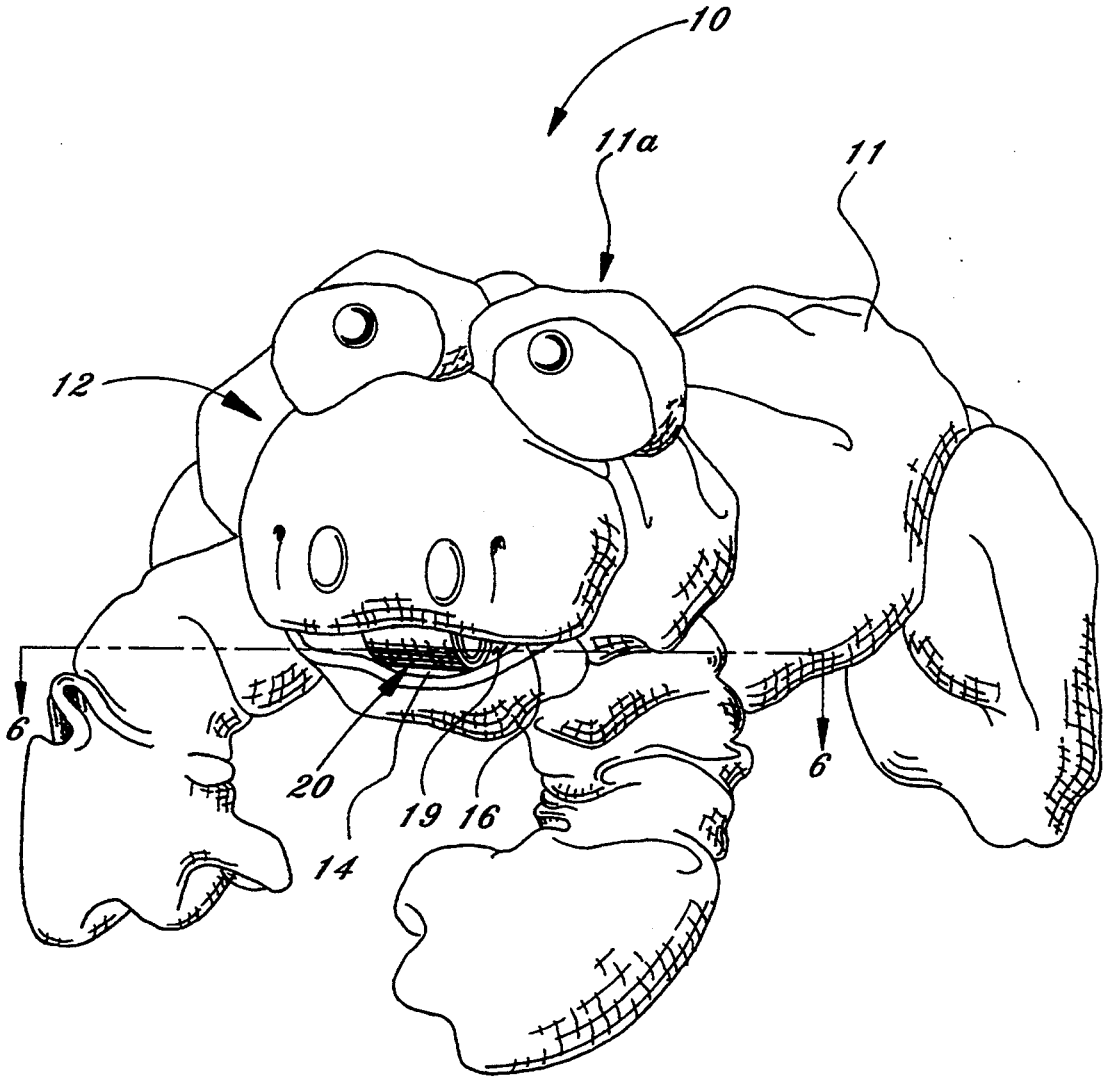
FIG. 1 is a perspective view of the preferred embodiment of the instant invention illustrating the tongue in the coiled position.

With reference to the drawings, FIGS. 1–9 depict an animated toy and retractable tongue combination generally indicated by the reference numeral 10, comprising a body 11, a resilient jaw 12, and an extendable, retractable tongue member 20. As illustrated in FIG. 1, the body 11 of the animated toy generally comprises a stuffed animal structure having a head **11*a* that embodies the resilient jaw 12 and the extendable, retractable tongue member 20. The resilient jaw 12 is movable between an open or first position and a closed or second position. Meanwhile, the extendable tongue member 20 has two corresponding positions, an extended position when the jaw 12 is opened and a retracted or coiled position when the jaw is closed. Both the jaw 12 and the tongue member 20** are specifically designed to be universally adaptable to any toy animal structure.

Figure 2:
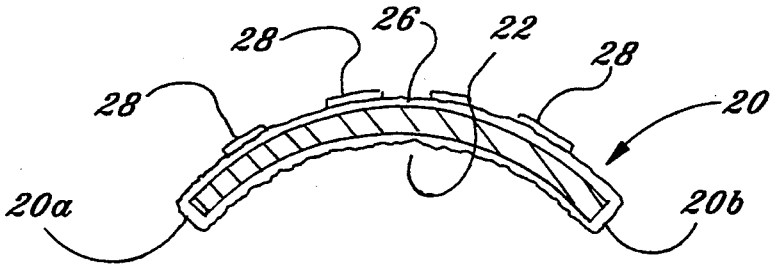
FIG. 2 is a cross-sectional view of an extended tongue illustrating the tongue's arcuate shape.
Figure 3:
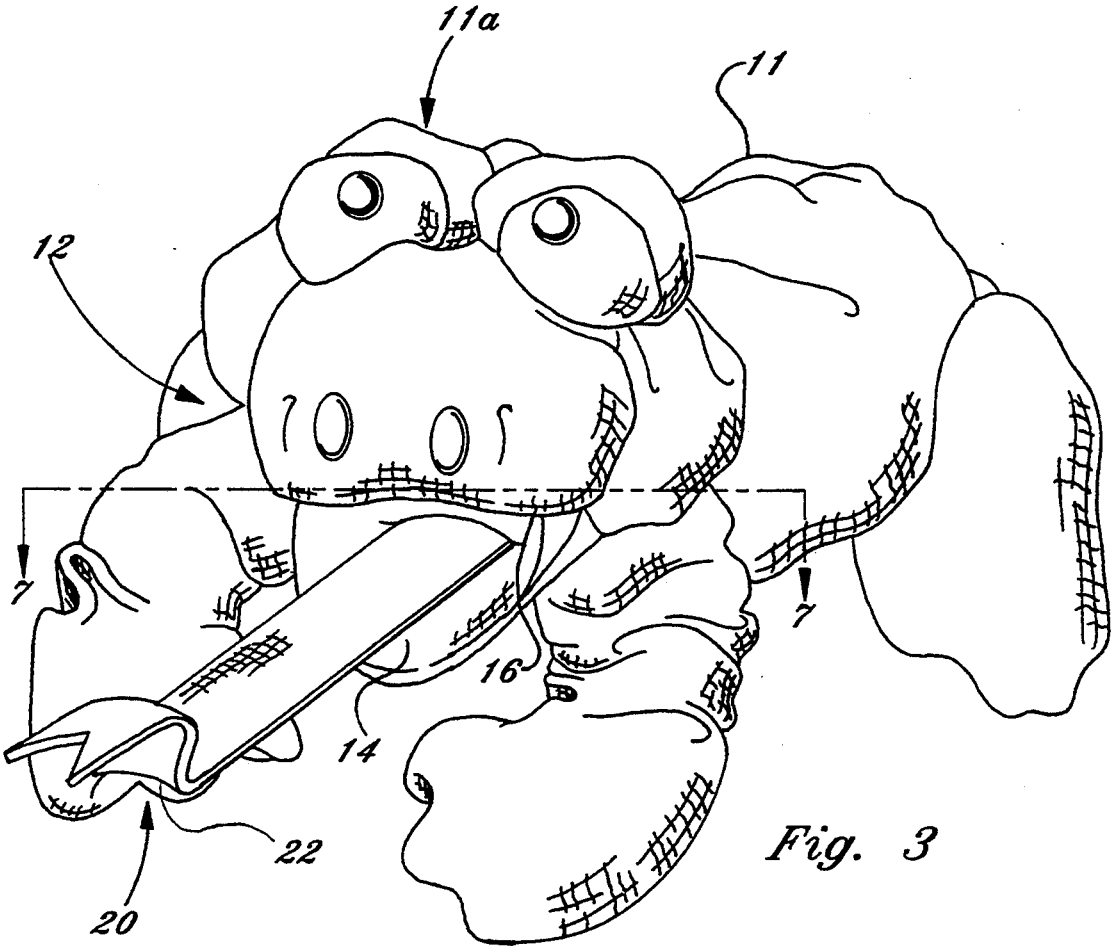
FIG. 3 is a perspective view of the preferred embodiment of the instant invention illustrating the tongue as it is moved into the extended position.
Figure 4:
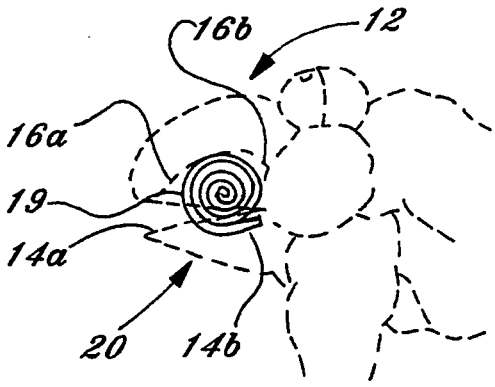
FIG. 4 is a partial side elevational view of the instant invention depicting the tongue member coiled inside the mouth with the animal head shown in phantom.
Figure 5:
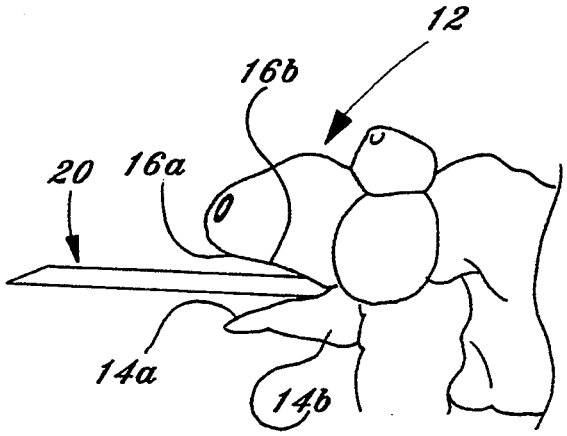
FIG. 5 is a partial side elevational view of the instant invention illustrating the tongue in the fully extended position.
Figure 9:
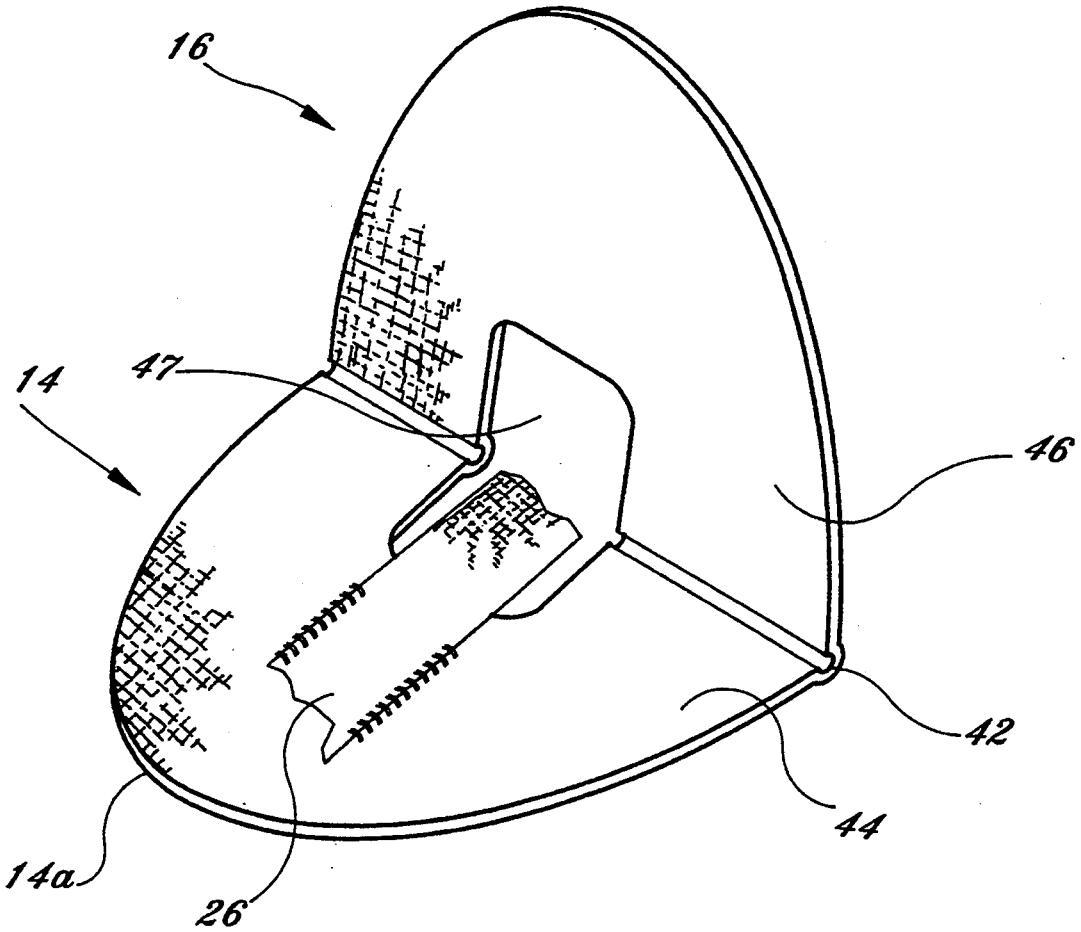
FIG. 9 is a perspective view of the jaw of the present invention illustrating a fragmentary tongue member attached to the lower jaw member and further illustrating the living hinge element of the present invention.

With reference to FIGS. 1–4 and FIG. 9, the resilient jaw 12 defines a mouth and is comprised of an upper jaw member 16 and a lower jaw member 14. The upper and lower jaw members 16, 14 each comprise a substantially flat, planar, rigid flap preferably made of plastic or the like having proximal ends **16*a* and 14*a*, respectively, at the front of the mouth and distal ends 16*b* and 14*b*, respectively, at the rear of the mouth as shown in FIGS. 4 and 5. A wire frame (not shown) may be disposed around the peripheral edges of the jaw members 16,14 for more rigid support. As seen in FIG. 9, the upper and lower jaw members 16,14 are preferably hingedly connected at their respective distal ends or at the corners of their respective distal ends in a living hinge arrangement 42 to effectuate an articulate jaw structure, facilitating the divergence and convergence of the proximal ends 16*a*,14*a* to fully open or close the jaw 12, respectively. As seen in FIG. 9, upper and lower jaw members 16,14 may be molded as one continuous unit rather than two separate pieces. Fabric portions 46 and 44 are attached to upper and lower jaw members 16,14 respectively by glue, stitching or the like. Alternatively, a continuous fabric sheet may be used to cover upper and lower jaw members 16,14. To facilitate the open position, the jaw members 16,14 are manually pulled apart by the user to expose the tongue member 20 found therein. In the preferred embodiment, the articulate jaw 12** maintains the open position until manipulated by an opposing force. Alternatively, the living hinge may be removed from the jaw, wherein the upper and lower jaw members remain open by the force of gravity and the tongue member in its extended position.

The jaw members 16,14 are fabricated from a light durable material, such as thin plastic, and hingedly communicate at the distal ends **16*b*,14*b* so that the jaw members have a natural tendency to diverge or remain open at the proximal ends 16*a*,14*a*. When the tongue member 20 is placed in the extended position, as in FIGS. 3, 5, 7 and 8, the metal band becomes arcuate in cross section laterally (see FIGS. 2 and 8) and rigid. The lower jaw member 14 is incapable of overcoming the arcuate bend of the extended tongue member 20 as it rests against the edges 20*a* and 20*b* which define the curvature 22 shown in FIG. 2. Referring to FIGS. 1 and 4, once the tongue member 20 retracts from the elongated position back into the jaw 12, the upper and lower members 16,14 close due to the spring action and attachment of the tongue member to the lower jaw member, and form a cavity 19 therein for storing the coiled tongue member 20. Hence, the upper member 16 and the lower member 14 may be concave to form a more adaptable and spacious cavity 19 for enclosing the coiled tongue member 20 when the jaw 12** is closed.

Figure 6:
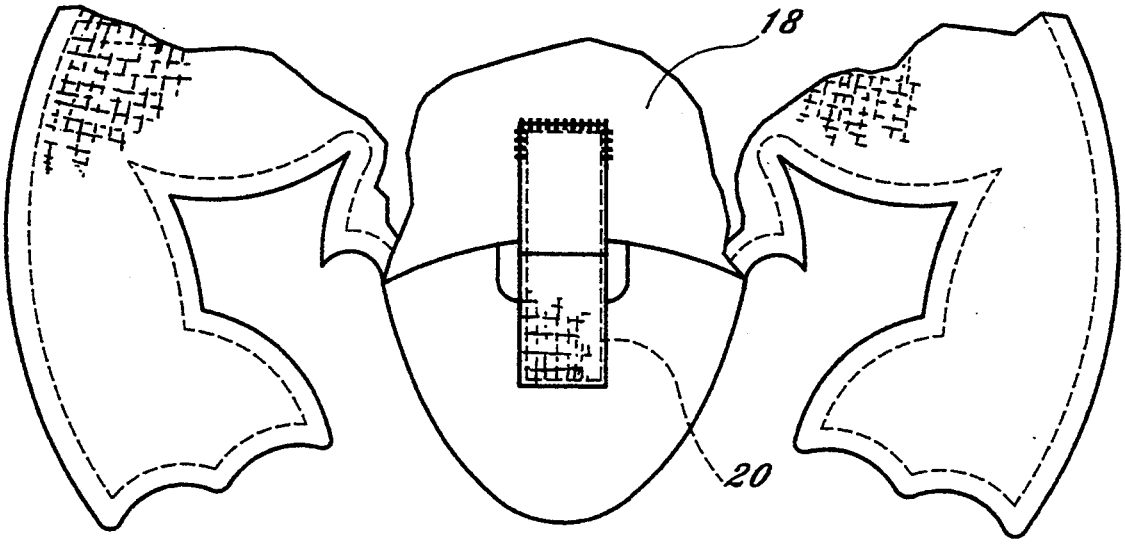
FIG. 6 is a cross sectional view, partially broken away, of the front of the animal taken along line 6—6 of FIG. 1 illustrating the tongue member coiled and attached to the throat.
Figure 7:
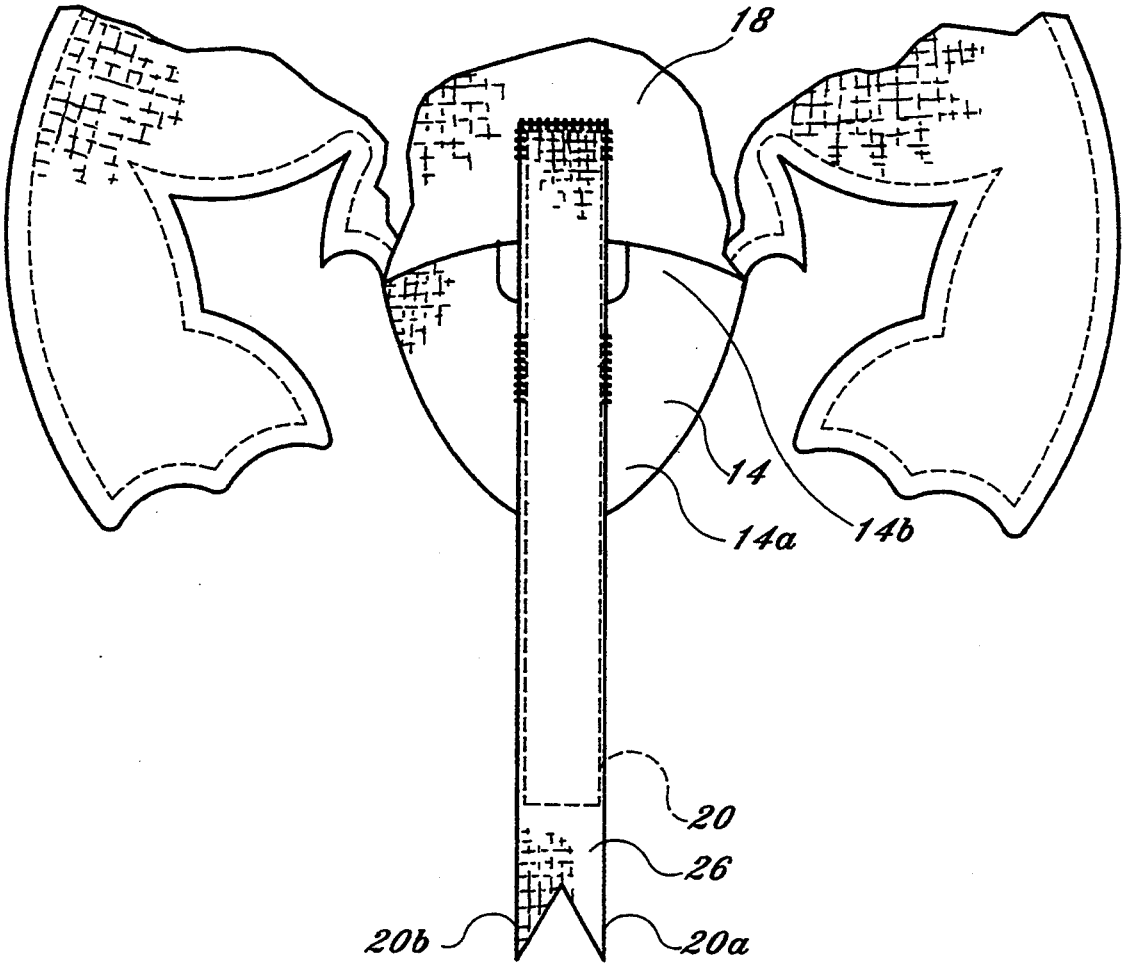
FIG. 7 is a cross sectional view, partially broken away, of the front of the animal taken along line 7—7 of FIG. 3 illustrating the tongue member extended and attached to the throat and lower jaw member.
Figure 8:
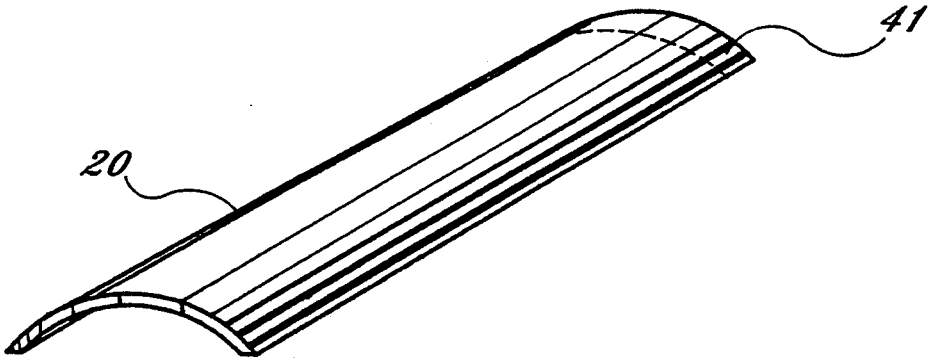
FIG. 8 is a perspective view illustrating the tongue element of the present invention.

The manually extendable and automatically retractable tongue member 20 typically comprises an elongated spring-actuated steel or stainless steel band that is fixedly secured or attached to both the lower jaw member 14, and to the throat 18 between the upper and lower jaw members 16,14 as seen in FIGS. 6 and 7. The secured attachment of the tongue member 20 to the lower jaw member 14 and to the throat 18 secures one end for manually extending and automatically retracting the tongue by outside forces, and effectuates responded closure of the jaw 12 when the tongue member 20 retracts. As seen in FIG. 8, tongue member 20 has a heat treated end portion 41 so that the tongue member 20 does not coil at that end. The end portion 41 that is heat treated is then attached to the throat 18 (FIGS. 6 and 7) through aperture 47 (FIG. 9). In the preferred embodiment, the tongue member or band 20 is fabricated from a long, narrow, thin piece of type 301 stainless steel having an arcuate curvature cross section, as seen in FIGS. 2, 3, and 8 when in the extended position. Typical dimensions for tongue member 20 may be 1 inch in width, 0.005 inches in thickness, a curvature cross section of 1.5 inches, and any length. The tongue member 20 effectively becomes arcuate when it is extended making the tongue rigid and facilitating the storage of potential energy in the spring-actuated band as it is extended from its normally coiled position. When the arcuate curved structure of the tongue member 20 is displaced by a force that causes a displacement in the curvature 22, the potential energy in the tongue member 20 is converted into kinetic energy, causing the tongue member 20 to automatically retract or coil back into its normal position within the mouth. In effect, by breaking the plane of curvature 22, the tongue loses its rigid support at that point and is overcome by the stored energy in the spring-actuated tongue member 20 and forced to coil back into its natural, coiled, rolled position within the mouth. In the first or extended position, the tongue member 20 is rigid and elongated, wherein it protrudes from the jaw 12 which is in the fully opened position. In the second or coiled position, the tongue member 20 is coiled inside the mouth, which is in its corresponding closed position.

In the preferred embodiment, to access the tongue from within the jaw cavity 19, the jaw members 14,16 are manually forced apart and held apart by the living hinge 42, and the tongue is manually unwound from its coiled position inside the cavity 19 to its rigid, elongated, and extended position outside the cavity 19. The tongue member 20 may be triggered into its second position merely by exerting a downward deforming force on its arcuate top surface 22 with a finger or an object. In the preferred embodiment, the force of the tongue when it retracts or coils back into the mouth imposes a force sufficient to overcome the "opening" force of living hinge 42, and also imposes a force on the throat 18 of the head **11*a* to transfer energy to the lower and upper jaw members 14,16 to overcome their natural propensity to remain open. Likewise, in the alternative embodiment without the living hinge, when the tongue member 20 retracts back into the mouth, the downward force exerted by tongue member 20 on lower jaw member 14 is no longer present, thereby inducing jaw members 14 and 16** to close.

In the preferred embodiment as seen in FIG. 2, the tongue is covered or insulated with a fabric pile or woven material 26 and includes fabric fasteners 28 disposed on its outer surface for attaching objects, such as toy insects or balls. The fabric fasteners 28 typically comprise a hook and loop arrangement, known under the trademark VELCRO®, and correspondingly attach to fabric fastener attachments found on the objects. Other adhesives may be applied to the outer surface of the fabric pile to secure objects in place on the tongue. Alternatively, the fabric pile covering may be a furry or fuzzy material having sufficient friction such that an object placed upon the tongue's covering will be frictionally engaged with the tongue as the tongue recoils. The attachment of objects on the tongue member 20 allows a child to actually simulate the capturing of food or objects for the simulated animal, giving a somewhat realistic depiction of the feeding habits of certain animals. The objects may be gently placed on the tongue so as to not break the plane of curvature 22, allowing the child to subsequently exert the required force on the arcuate curvature 22 of the tongue, causing it to automatically recoil. Alternatively, the tongue may be forced to retract by the placement of the object on the tongue's outer surface with sufficient force to break the plane of curvature, causing the tongue to capture the object as it coils back into the creature's mouth. The tongue member 20 may be securely attached at its distal end by stitching the tongue member fabric 26 to the animal toy inside the throat 18, as shown in FIGS. 6 and 7. Alternatively, the tongue member 20 itself, or the tongue member with the fabric covering 26, may be attached by stapling or adhesives and still fall within the scope of the invention.

To utilize the present invention, the upper and lower jaws 16,14 of the simulated creature are manually forced apart. The living hinge arrangement allows the jaws to open until forced closed by the retracting tongue. After opening the jaws, the tongue may be pulled outward into the extended position, where it remains as a result of its own natural arcuate construction. The spring-actuated tongue member 20 is forced to recoil automatically when a sufficient force is exerted downward against the curvature 22 by either a finger, object, or other means. Thus, a child may extend the tongue to its elongated position, place foreign objects on the tongue for attachment, and cause the spring-actuated member to recoil. The retraction of the spring will force the mouth to close automatically, encompassing whatever is attached to the tongue.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An animated toy figure, comprising:

a head including a throat;

an articulate jaw disposed in said head to define a movable mouth, said articulate jaw movable between an open position and a closed position to cause the mouth to be opened and closed, respectively; and a tongue member disposed in said mouth and having a proximal end and a distal end, said tongue member distal end fixedly attached to said throat, said tongue member being movable between an extended position and a retracted position, said tongue member having an arcuate curvature cross section in the extended position, thereby allowing said tongue member to remain in the extended position indefinitely, said tongue member automatically retracting upon actuation by contact when the arcuate curvature is deformed by a force that causes a displacement in the arcuate curvature, wherein said tongue member is retracted and coiled for storage inside the mouth when said jaw is closed.

2. An animated toy figure as recited in claim 1, wherein said tongue member distal end is heat treated to prevent coiling.

3. An animated toy figure as recited in claim 1, wherein said articulate jaw comprises:

an upper jaw member having a distal end and a proximal end;

a lower jaw member having a distal end and a proximal end; and means for hingedly connecting said upper jaw distal end and said lower jaw distal end;

said closed position having said upper jaw member proximal end and said lower jaw member proximal end spaced substantially close to each other such that said upper jaw member and said lower jaw member are substantially parallel;

said open position having said upper jaw member proximal end and said lower jaw member proximal end spaced apart from each other.

4. An animated toy figure as recited in claim 3, wherein said means for hingedly connecting comprises a living hinge.

5. An animated toy figure as recited in claim 3, further comprising an aperture proximal said upper jaw member distal end and said lower jaw member distal end for receiving said tongue member distal end.

6. An animated toy figure as recited in claim 3, wherein said throat is disposed behind said upper jaw member distal end and said lower jaw member distal end.

7. An animated toy figure as recited in claim 3, wherein said tongue member is fixedly attached to said lower jaw member.

8. An animated toy figure as recited in claim 1, further comprising a means for attaching objects to an upper surface of said tongue member.

9. An animated toy figure as recited in claim 1, wherein said tongue member further comprises a fabric cover.

10. An animated toy figure, comprising:

a head including a throat;

an articulate jaw disposed in said head to define a movable mouth, said articulate jaw movable between an open position and a closed position to cause the mouth to be opened and closed, respectively, said articulate jaw comprising an upper jaw member and a lower jaw member, each jaw member being a substantially flat, planar, rigid member having a proximal end and a distal end;

a living hinge hingedly connecting said upper jaw member distal end and said lower jaw member distal end; and a tongue member disposed in said mouth, said tongue member having a proximal end and a distal end, said tongue member distal end fixedly attached to said throat through an aperture proximal said upper jaw member distal end and said lower jaw member distal end, said tongue member further being fixedly attached to said lower jaw member, said tongue member being movable between an extended position and a retracted position, said tongue member comprising an elongated spring-actuated band having an arcuate curvature cross section when said tongue is in the extended position, said arcuate curvature facilitating storage of potential energy in the spring-actuated band as the spring-actuated band is extended from a retracted, coiled position to the extended position, such that when the arcuate curvature of the tongue member is displaced by a predetermined force, the potential energy in the tongue member is converted into kinetic energy, causing the tongue member to automatically retract and coil back into the mouth when said jaw is closed.

11. An animated toy figure as recited in claim 10, further comprising a means for attaching objects to an upper surface of said tongue member.

12. An animated toy figure as recited in claim 10, wherein said tongue member further comprises a fabric cover.

13. An animated toy figure as recited in claim 10, wherein said tongue member distal end is heat treated to prevent coiling.

* * * * *